US009970367B2

(12) United States Patent
Dudar et al.

(10) Patent No.: US 9,970,367 B2
(45) Date of Patent: May 15, 2018

(54) SYSTEMS AND METHODS FOR TARGETED HEATING IN AN EVAPORATIVE FUEL VAPOR CANISTER PURGE

(71) Applicant: Ford Global Technologies, LLC, Dearborn, MI (US)

(72) Inventors: Aed M. Dudar, Canton, MI (US); Robert Roy Jentz, Westland, MI (US); Douglas Raymond Martin, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 174 days.

(21) Appl. No.: 15/190,068

(22) Filed: Jun. 22, 2016

(65) Prior Publication Data

US 2017/0370306 A1 Dec. 28, 2017

(51) Int. Cl.

| | |
|---|---|
| ***F02D 41/00*** | (2006.01) |
| ***F02D 41/30*** | (2006.01) |
| ***F02D 41/14*** | (2006.01) |
| ***F02M 25/08*** | (2006.01) |

(52) U.S. Cl.

CPC ..... *F02D 41/0032* (2013.01); *F02D 41/1439* (2013.01); *F02D 41/3005* (2013.01); *F02M 25/0854* (2013.01); *F02M 2025/0881* (2013.01)

(58) Field of Classification Search

CPC ..... F02D 41/0032; F02D 41/1439; F02D 41/3005; F02M 25/0854; F02M 2025/0881

See application file for complete search history.

(56) References Cited

U.S. PATENT DOCUMENTS

| | | | | |
|---|---|---|---|---|
| 2,315,881 | A * | 4/1943 | Thomas | F02M 13/08 123/525 |
| 4,338,905 | A * | 7/1982 | Urich | F02M 27/08 123/518 |
| 4,429,675 | A * | 2/1984 | Talbert | F02M 27/08 123/557 |
| 5,002,033 | A * | 3/1991 | Housand, Sr. | F02M 5/00 123/1 A |
| 5,857,446 | A * | 1/1999 | Norton | F02M 25/0854 123/516 |
| 5,875,765 | A * | 3/1999 | Norton | F02M 25/0854 123/516 |
| 6,732,720 | B2 * | 5/2004 | Kelemencky | F02M 27/08 123/536 |

(Continued)

FOREIGN PATENT DOCUMENTS

CN 101590398 A 12/2009

OTHER PUBLICATIONS

Dudar, Aed M., "Systems and Methods for Diagnosing Components in a Vehicle Evaporative Emissions System," U.S. Appl. No. 15/248,817, filed Aug. 26, 2016, 67 pages.

*Primary Examiner* — Hieu T Vo
*Assistant Examiner* — Sherman Manley
(74) *Attorney, Agent, or Firm* — Julia Voutyras; McCoy Russell LLP

(57) ABSTRACT

Methods and systems are provided for an ultrasonic wave generator within a vehicle emissions control system. In one example, a frequency of ultrasonic waves may be applied to a fuel vapor canister, the frequency adjusted in response to an estimate of hydrocarbon distribution within a vapor canister received from temperature and hydrocarbon sensor outputs.

20 Claims, 7 Drawing Sheets

(56) References Cited

U.S. PATENT DOCUMENTS

| | | | | |
|---|---|---|---|---|
| 2004/0191583 | A1* | 9/2004 | Kelley | H01M 8/04126 429/413 |
| 2014/0360260 | A1 | 12/2014 | Dudar et al. | |
| 2015/0160180 | A1* | 6/2015 | Balsdon | G01F 1/42 123/519 |
| 2015/0337766 | A1* | 11/2015 | Jones | F02M 17/22 261/153 |

* cited by examiner

SYSTEMS AND METHODS FOR TARGETED HEATING IN AN EVAPORATIVE FUEL VAPOR CANISTER PURGE

FIELD

The present description relates generally to systems and methods for an ultrasonic wave generator of a fuel vapor canister of a vehicle.

BACKGROUND/SUMMARY

Vehicle emission control systems may be configured to store fuel vapors from fuel tank refueling and diurnal engine operations in a fuel vapor canister, and then purge the stored vapors during a subsequent engine operation. The stored vapors may be routed to engine intake for combustion, further improving fuel economy.

The conditions for enabling purging of fuel vapors may be significantly limited, particularly in stop/start and/or hybrid powertrains. One approach to increase the rate of hydrocarbon release from the storage canister may include heating.

However, the inventors herein have recognized issues with such approaches. For example, some heating approaches can require significant electrical energy, and themselves create still further delays due to temperature dynamics. Further, the heating may be difficult to quickly isolate in specific locations where hydrocarbons are stored for a given set of storage and purging conditions. In one example, at least some of the above issues may be at least partly addressed by a method comprising adjusting a frequency of ultrasonic waves applied to a fuel vapor canister of a vehicle based on an operating condition.

In this way, ultrasonic waves can be used to quickly release hydrocarbons in different locations of the canister. For example, by adjusting the frequency of the ultrasonic waves, the waves can target different spatial positions within the canister for quicker release of stored hydrocarbons at different times of the same purging event. In an embodiment, the frequency may be adjusted during a single purge event so that at different times of the purge duration, different locations of the canister are targeted for assistance in releasing hydrocarbons so that a more complete purging of the canister is achieved in a reduced time, even if fresh air flow is limited due to limited engine vacuum, and even if certain locations within the canister are more heavily loaded with hydrocarbons than others locations within the canister, for example. The system may track the storage levels at the different spatial positions inside the canister so that the frequency can be adjusted taking into account the different storage levels, and how those levels change differently during the purge event.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
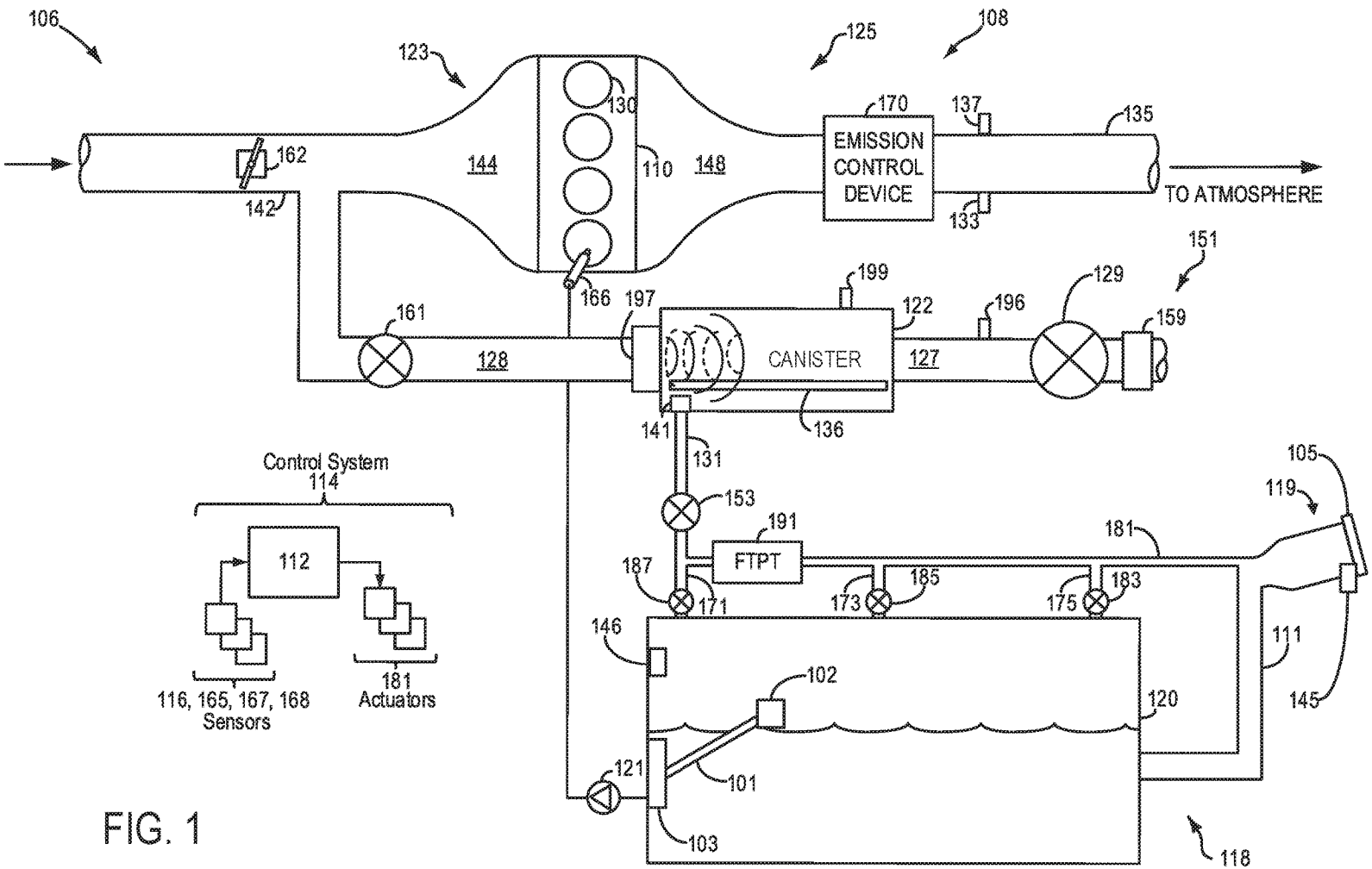
FIG. 1 shows a schematic depiction of a vehicle system with a fuel system and an evaporative emissions control system.
Figure 2:
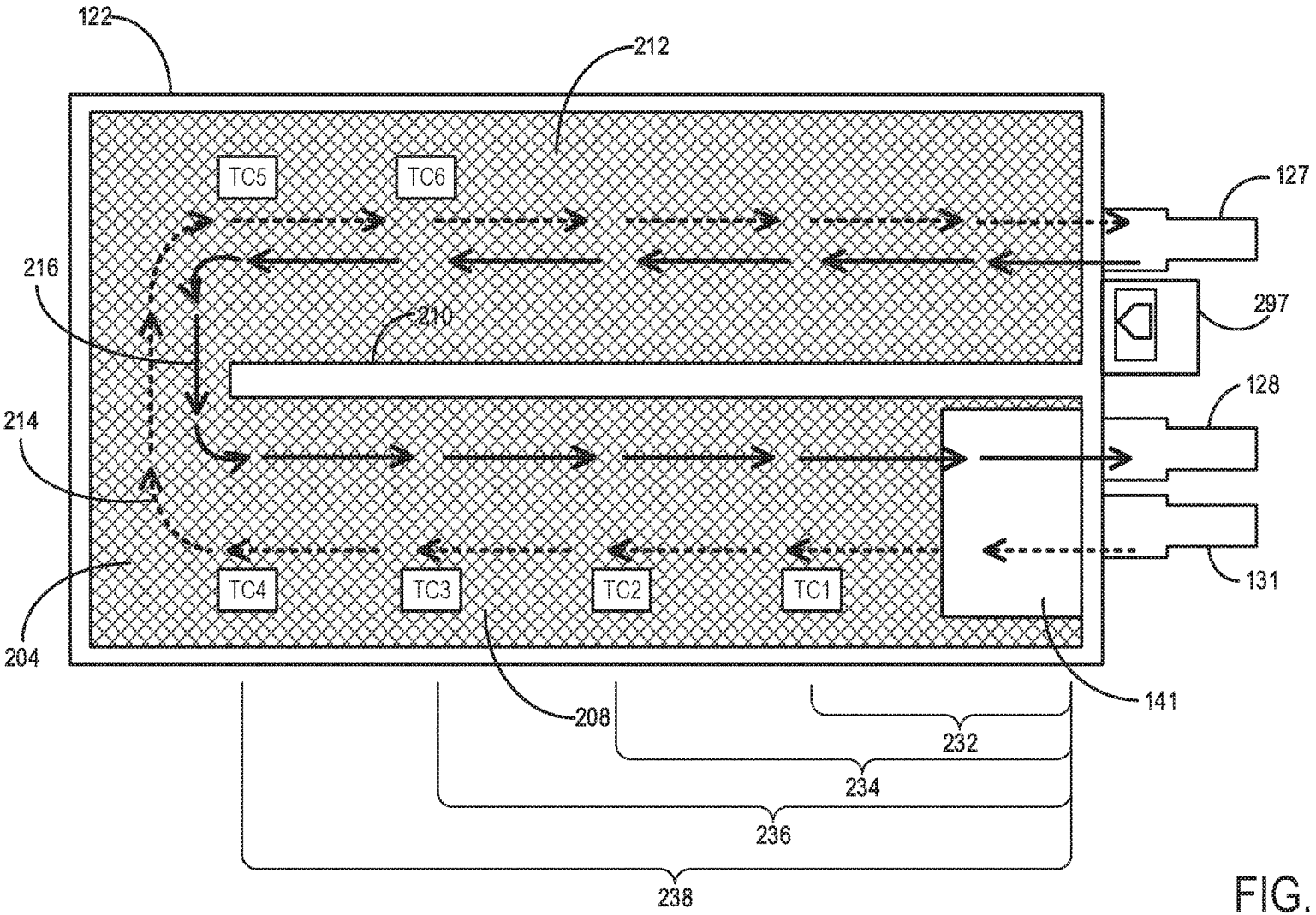
FIG. 2 shows an alternate embodiment of a canister of an evaporative emissions control system of the present disclosure, having multiple temperature sensors.
Figure 3:
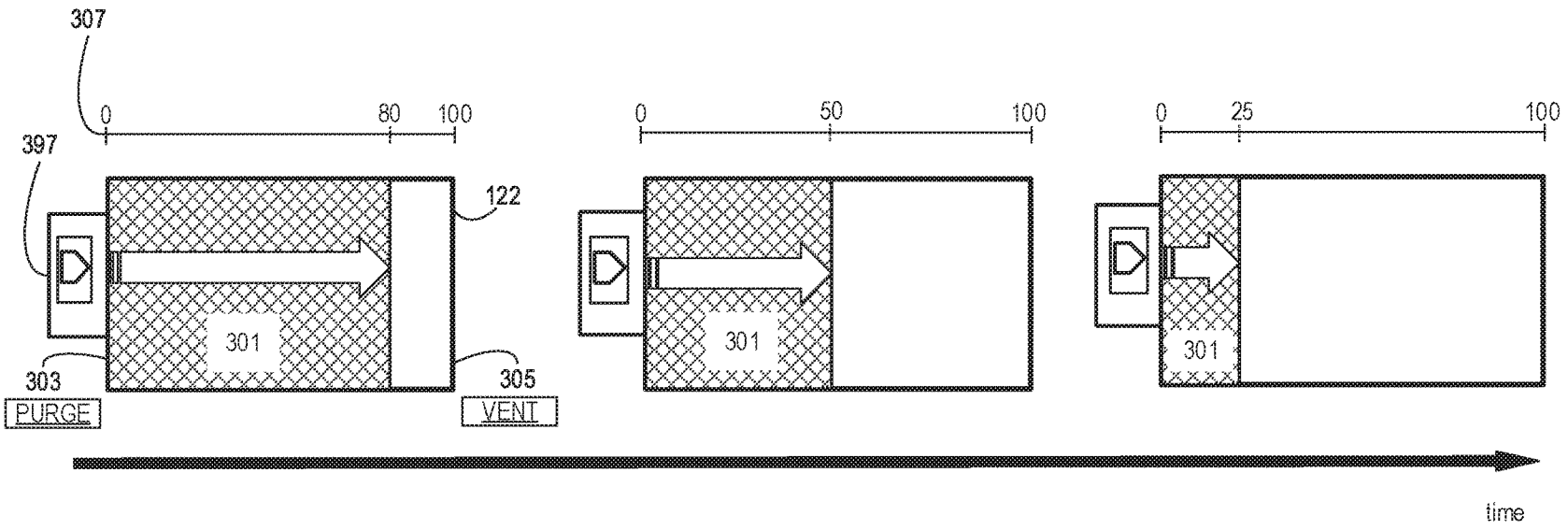
FIG. 3 shows an alternate embodiment of a carbon canister of an evaporative emissions control system of the present disclosure, utilizing an ultrasonic wave generator during a purging event.
Figure 4:
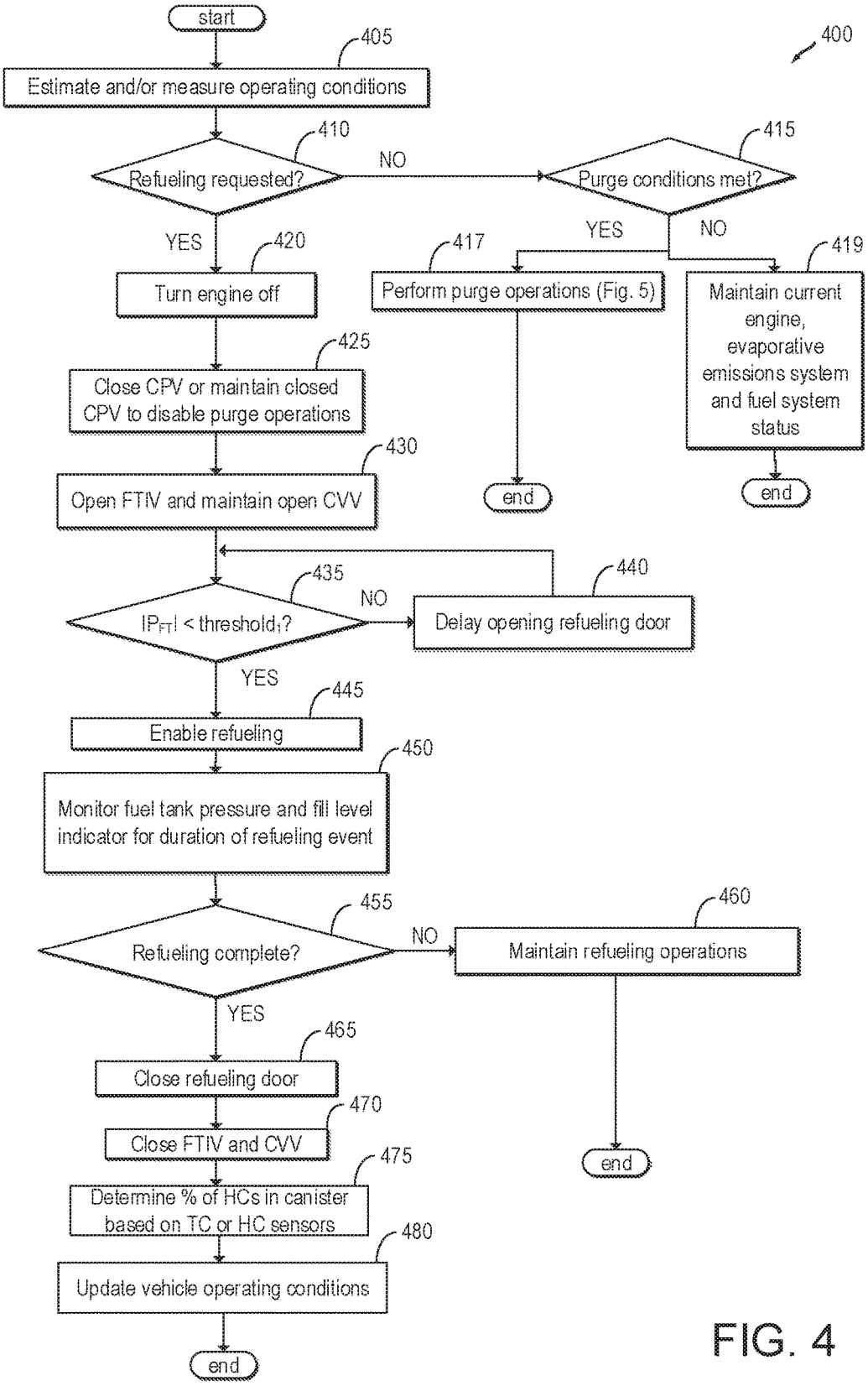
FIG. 4 shows an example method for determining an amount of hydrocarbons added to a carbon canister during a refueling event.
Figure 5:
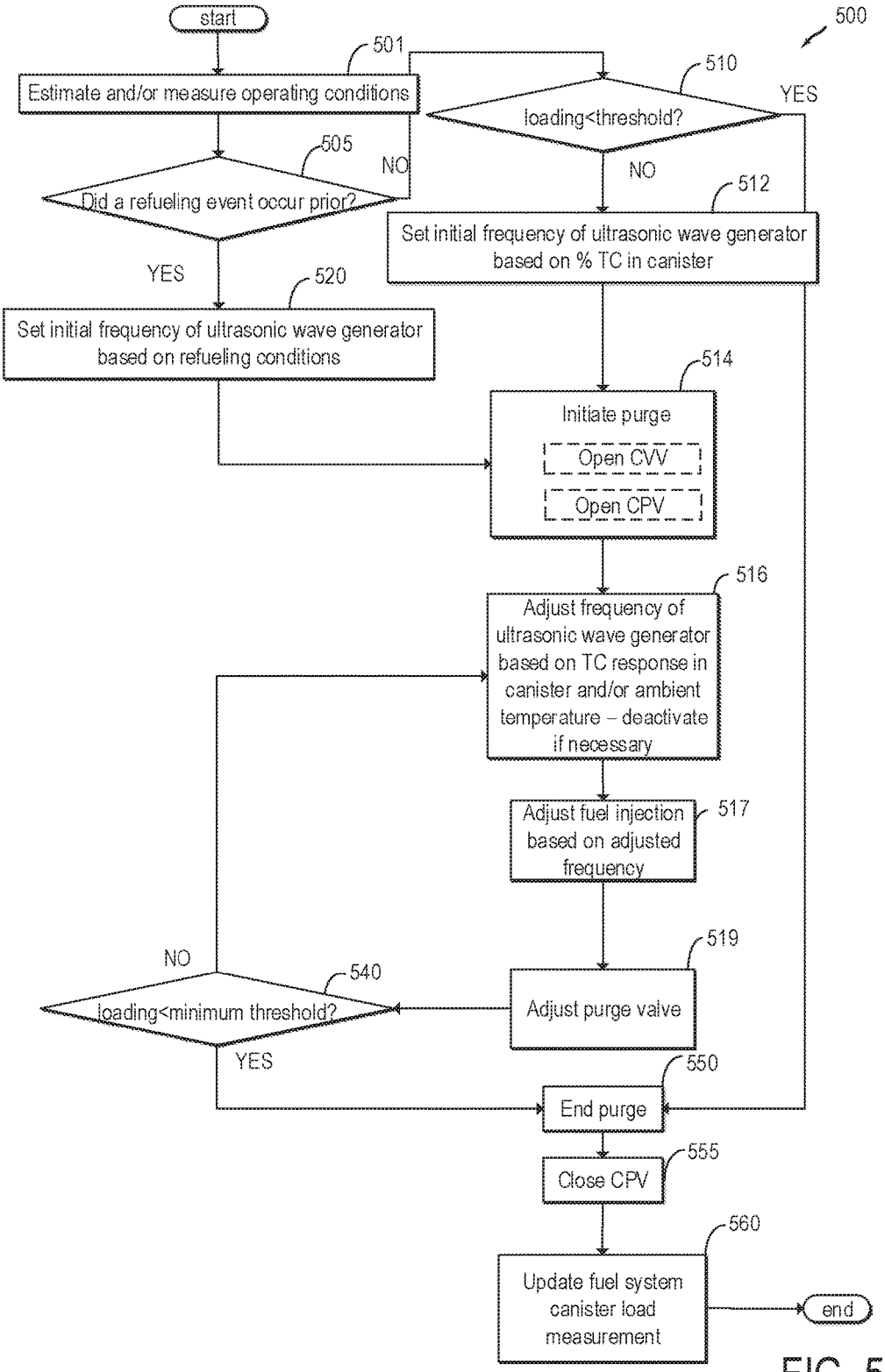
FIG. 5 shows an example method for controlling an ultrasonic wave generator during a purge event.
Figure 6:
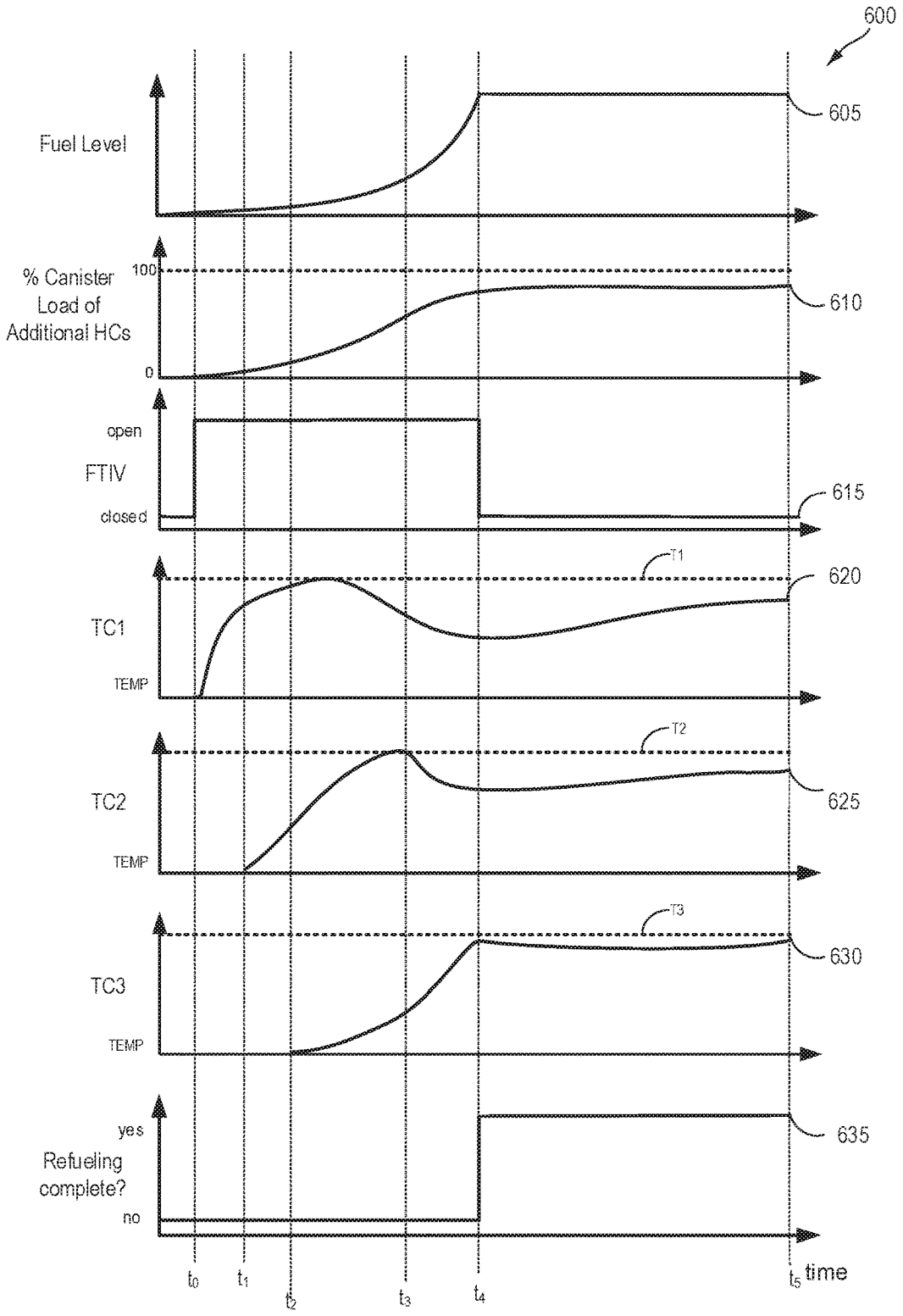
FIG. 6 shows an example graph showing changes of the outputs of temperature sensors during a refueling event.
Figure 7:
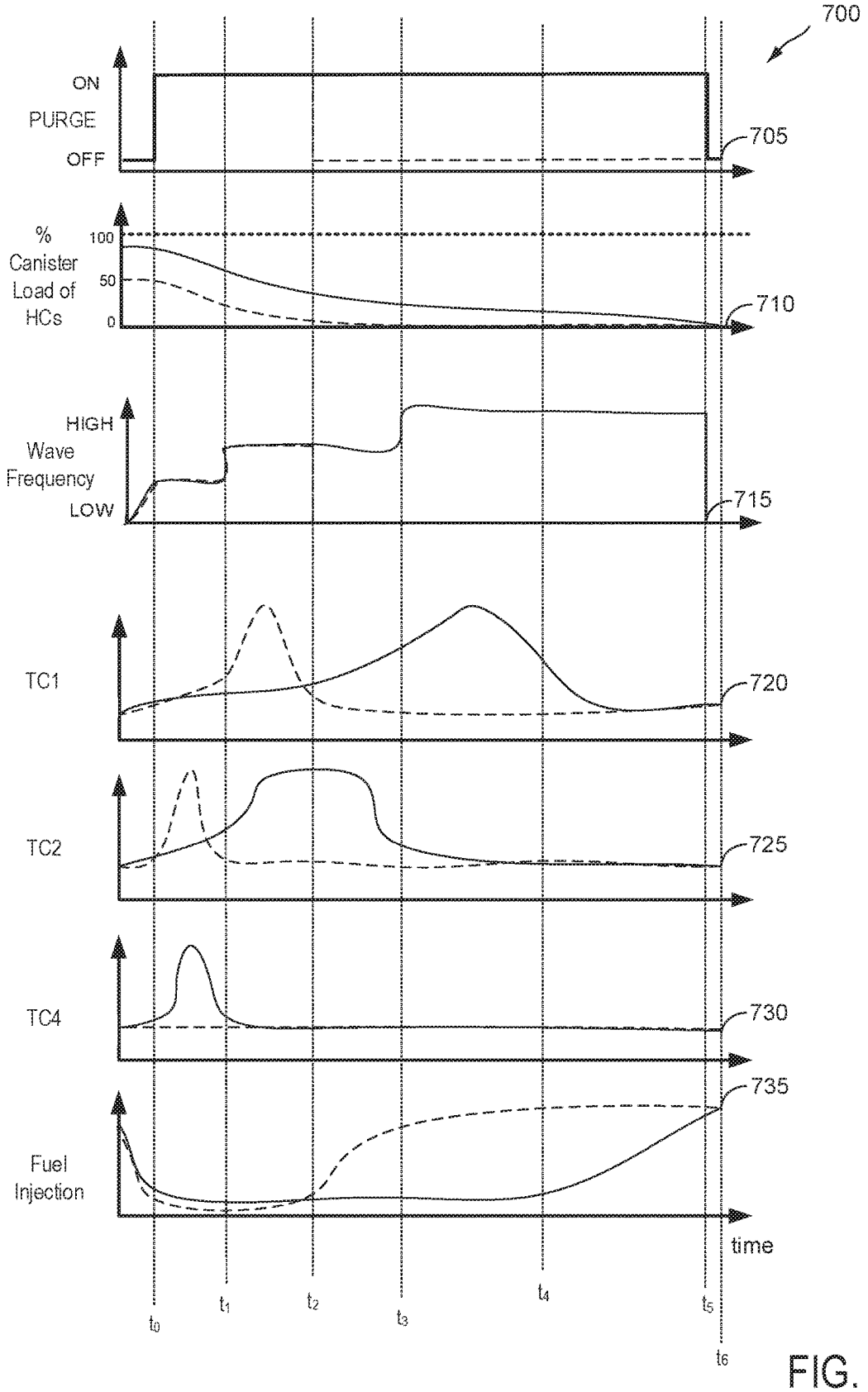
FIG. 7 shows an example graph showing changes of the outputs of temperature sensors during a purge event.

The following description relates to systems and methods for targeted heating in an evaporative fuel vapor canister based on the loading and/or distribution of hydrocarbons in the canister included in an evaporative emission control system in a vehicle, such as the example vehicle shown in FIG. 1. As shown in FIG. 2, a carbon canister may include one or more temperature sensors (e.g., thermocouples) disposed at various locations within the canister for monitoring temperature changes during a refueling event when fuel is replenished in the fuel tank and/or during a purge event when stored vapors are purged from the fuel tank. During a refueling event, the fuel tank is vented to the atmosphere through the carbon canister so that fuel vapors are adsorbed in an adsorbent, e.g., activated carbon, in the canister. During a purge event, air from the atmosphere is vented through the carbon canister to release stored vapor to the engine intake for combustion. FIG. 3 shows different loading states of the canister that may be identified and used to adjust the ultrasonic waves applied during purging operation and how an ultrasonic wave generator may be used for controlled heating of the carbon canister for targeted release of hydrocarbons. FIGS. 4-5 show an example routine for controlling storing and/or purging operation to take advantage of the adjustable ultrasonic waves applied during purging. FIGS. 6-7 show examples where temperature sensors may be used to indicate and monitor an amount and/or distribution of hydrocarbons stored in particular zones of the carbon canister and where such information is determined by the controller and then used to adjust the frequency during the purging event. Based on this information, a more accurate control of the ultrasonic generator may be achieved.

Turning now to the figures, FIG. 1 shows an example vehicle system 106 with a fuel system 118 and an evaporative emissions control system 151. The vehicle system 106 includes an engine system 108 coupled to an emissions control system 151 and a fuel system 118. Emission control system 151 includes a fuel vapor container or canister 122 which may be used to capture and store fuel vapors. Further, emission control system 151 includes an ultrasonic wave generator 197 for targeting heating of stored fuel vapors. In some examples, vehicle system 106 may be a hybrid vehicle system, e.g., a hybrid-electric vehicle (HEV) or a plug-in hybrid-electric vehicle (PHEV). However, in other examples, vehicle system 106 may not be a hybrid vehicle system and may be propelled via the engine system 108 only.

The engine system 108 may include an engine 110 having a plurality of cylinders 130. The engine 110 includes an engine intake 123 and an engine exhaust 125. The engine intake 123 includes a throttle 162 fluidly coupled to the engine intake manifold 144 via an intake passage 142. The engine exhaust 125 includes an exhaust manifold 148 leading to an exhaust passage 135 that routes exhaust gas to the ambient atmosphere. The engine exhaust 125 may include one or more emission control devices 170, which may be mounted in a close-coupled position in the exhaust. One or more emission control devices may include a three-way catalyst, lean NOx trap, diesel particulate filter, oxidation catalyst, etc. It will be appreciated that other components may be included in the engine such as a variety of valves and sensors.

Fuel system 118 may include a fuel tank 120 coupled to a fuel pump system 121. The fuel pump system 121 may include one or more pumps for pressurizing fuel delivered to the injectors of engine 110, such as the example injector 166 shown. While only a single injector 166 is shown coupled to the engine, additional injectors are provided for each cylinder. It will be appreciated that fuel system 118 may be a return-less fuel system, a return fuel system, or various other types of fuel system. Fuel tank 120 may include a temperature sensor 146 disposed therein.

A fuel level sensor 103 may be included in fuel tank 120 to determine an amount of fuel in the fuel tank. For example, fuel level sensor 103 may include an arm 101 coupled to a float 102. In this example, the position of the float 102 on the top surface of the fuel volume may be used to determine a fuel level in the fuel tank.

Vapors generated in fuel system 118 may be routed to an evaporative emissions control system 151 which includes a fuel vapor canister 122 via vapor recovery line 131, before being purged to the engine intake 123. Fuel vapor canister 122 may include a load port 141 to which fuel vapor recovery line 131 is coupled. Further, one or more temperature sensors 136 (e.g., thermocouples) may be included in fuel vapor canister 122 so that temperature changes in the fuel vapor canister may be monitored to infer hydrocarbon loading as described below. The one or more temperature sensors may be located within canister 122 at various locations. For example, canister 122 may include a temperature sensor adjacent to load port 141 and/or at various depths within the adsorbent in the canister. An example, canister including one or more temperature sensors is described below in FIG. 2.

Fuel vapors may undergo an exothermic reaction when carbon in the canister adsorbs vapor from the fuel tank; thus temperatures of the fuel vapor canister, e.g., as determined by the one or more temperature sensors 136, may increase when vapors dispensed by a refueling pump enter the canister and are adsorbed into activated charcoal in the canister. During a refueling event, the exothermic reaction associated with vapor adsorption in the canister takes place leading to an increase of temperature in the canister; however, as more fuel is dispensed into the fuel tank, portions of the canister may become saturated so that the vapor flowing through the canister cools the adsorbent in the canister leading to a decrease in temperature in the canister. At the end of refueling, vapor diffusion from downstream portions of the adsorbent in the canister may cause a heating effect wherein the temperature again increases in the canister. Thus, as described in more detail below, these temperature changes in the canister may be used to infer an amount of hydrocarbons loaded into the canister. Further, the inferred amount may be useful for targeting of hydrocarbons by ultrasound wave generator 197 during a purging event.

Vapor recovery line 131 may be coupled to fuel tank 120 via one or more conduits and may include one or more valves for isolating the fuel tank during certain conditions. For example, vapor recovery line 131 may be coupled to fuel tank 120 via one or more or a combination of conduits 171, 173, and 175.

Further, in some examples, one or more fuel tank isolation valves may be included in recovery line 131 or in conduits 171, 173, or 175. Among other functions, fuel tank isolation valves may allow a fuel vapor canister of the emissions control system to be maintained at a low pressure or vacuum without increasing the fuel evaporation rate from the tank (which would otherwise occur if the fuel tank pressure were lowered). For example, conduit 171 may include a grade vent valve (GVV) 187, conduit 173 may include a fill limit venting valve (FLVV) 185, and conduit 175 may include a grade vent valve (GVV) 183, and/or conduit 131 may include an isolation valve 153. Further, in some examples, recovery line 131 may be coupled to a fuel filler system 119. In some examples, fuel filler system may include a fuel cap 105 for sealing off the fuel filler system from the atmosphere. Refueling system 119 is coupled to fuel tank 120 via a fuel filler pipe or neck 111. Further, a fuel cap locking mechanism 145 may be coupled to fuel cap 105. The fuel cap locking mechanism may be configured to automatically lock the fuel cap in a closed position so that the fuel cap cannot be opened. For example, the fuel cap 105 may remain locked via locking mechanism 145 while pressure or vacuum in the fuel tank is greater than a threshold. In response to an identification of a refueling event, the fuel tank may be depressurized and the fuel cap unlocked after the pressure or vacuum in the fuel tank falls below a threshold.

A fuel tank pressure transducer (FTPT) 191, or fuel tank pressure sensor, may be included between the fuel tank 120 and fuel vapor canister 122, to provide an estimate of a fuel tank pressure. The fuel tank pressure transducer may alternately be located in vapor recovery line 131, purge line 128, vent line 127 or other location within emission control system 151 without affecting its engine-off leak detection ability. As another example, one or more fuel tank pressure sensors may be located within fuel tank 120.

Emissions control system 151 may include one or more emissions control devices, such as one or more fuel vapor canisters, e.g., fuel vapor canister 122, filled with an appropriate adsorbent, the canisters are configured to temporarily trap fuel vapors (including vaporized hydrocarbons) during fuel tank refilling operations and "running loss" (that is, fuel vaporized during vehicle operation). In one example, the adsorbent used is activated charcoal. Emissions control system 151 may further include a canister ventilation path or vent line 127 which may route gases out of the canister 122 to the atmosphere when storing, or trapping, fuel vapors from fuel system 118.

One or more thermocouples (e.g., temperature sensor 136) may be coupled to and/or embedded inside canister 122. As fuel vapor is adsorbed by the adsorbent in the canister, heat is generated (heat of adsorption). Likewise, fuel vapor desorption by the adsorbent in the canister is endothermic. Hence, the adsorption and desorption of fuel vapor by the canister may be monitored and estimated by the controller based on temperature changes within the canister. Further, fuel vapor enters canister 122 via a load port 141 coupled to vent line 131. In this way, the canister loads hydrocarbons (HCs) in waves from the load port to the vent port. In an alternate embodiment, the canister may load HCs from a plurality of ports coupled to a vent line. Further, one or more HC sensors 199 may be used to determine the percentage of HCs as fuel vapor is adsorbed by the adsorbent in the canister during canister loading.

Ultrasonic wave generator 197 may be coupled to an outside or inside wall of canister 122. Ultrasonic wave generator 197 may be used to selectively heat the canister (and the adsorbent contained within), for example, to increase desorption of fuel vapors while performing a purge operation. Ultrasonic wave generator 197 may include an electromechanical actuator to emit frequencies within canister 122, and to directly and differentially heat different regions of the adsorbent located within canister 122. For example, the generator 197 may include one or more eletromechanical transducer elements to generate the ultrasonic waves. The frequency may be adjusted to target and increasing purging of vapors in different regions from load port 141 to the vent port. In an alternate embodiment, the vapors may be purged from vent port to load port. By adjusting the frequency of the ultrasonic waves, the waves can target different spatial positions to a greater extent within the canister for quicker release of stored hydrocarbons.

Vent line 127 may also allow fresh air to be drawn into canister 122 when purging stored fuel vapors from fuel system 118 to engine intake 123 via purge line 128 and purge valve 161. Purge valve 161 is coupled between canister 122 and engine intake 123, located along purge line 128. For example, purge valve 161 may be normally closed but may be opened during certain conditions so that vacuum from engine intake 144 is provided to the fuel vapor canister for purging. In some examples, vent line 127 may include an air filter 159 disposed therein upstream of a canister 122.

The purge valve 161 may be adjusted responsive to various operating conditions, as described herein. For example, the amount of purge flow, regulated by valve 161, may be adjusted responsive to a purge duration length, as well as based on feedback from exhaust oxygen sensors indicating potential air-fuel ratio disturbances generated by variations in the amount of hydrocarbons in the purge flow. In one example, valve 161 may be adjusted in a feed-forward manner responsive to the ultrasound frequency generated in the canister, and further responsive to estimated loading and distribution of the canister (for example determined based on the temperature profile and/or time variation of temperatures with the canister).

Flow of air and vapors between canister 122 and the atmosphere may be regulated by a canister vent valve 129. Canister vent valve may be a normally open valve so that one or more fuel tank isolation valves, e.g., valves 187, 185, 183 or 153 may be used to control venting of fuel tank 120 with the atmosphere. For example, in hybrid vehicle applications, a fuel tank isolation valve may be a normally closed valve so that by opening the isolation valve, fuel tank 120 may be vented to the atmosphere and by closing the isolation valve, fuel tank 120 may be sealed from the atmosphere. In some examples, a fuel tank isolation valve may be actuated by a solenoid so that, in response to a current supplied to the solenoid, the valve will open. For example, in hybrid vehicle applications, the fuel tank 120 may be sealed off from the atmosphere in order to contain diurnal vapors inside the tank since the engine run time is not guaranteed. Thus, for example, a fuel tank isolation valve may be a normally closed valve which is opened in response to certain conditions. For example, a fuel tank isolation valve may be commanded open following a detection of a refueling event so that the fuel tank is depressurized for refueling. The vehicle system 106 may further include a control system 114. Control system 114 is shown receiving information from a plurality of sensors 116 (various examples of which are described herein) and sending control signals to a plurality of actuators 181 (various examples of which are described herein). The control system 114 may include a controller 112. The controller may receive input data from the various sensors, process the input data, and trigger the actuators in response to the processed input data based on instruction or code programmed therein corresponding to one or more routines. For example, sensors 116 may include sensors coupled in the exhaust of the engine and located upstream of the emission control device such as an exhaust oxygen sensor 137 to sense oxygen levels of the exhaust gas flowing to the atmosphere and a temperature sensor 133 to sense the temperature of the exhaust gas flowing to the atmosphere. As another example, sensors 116 may include a sensor located in a ventilation path of a fuel vapor canister such as a sensor 196 to sense the temperature of the fresh atmospheric air flowing into the canister from the atmosphere or the temperature of the vapors flowing out of the canister to the atmosphere. As another example, sensors 116 may include a sensor located on a FTPT 191 that may sense the pressure of the fuel vapor within a fuel tank. As yet another example, sensors 116 may include a fuel level sensor 103, to sense a level of fuel within a fuel tank. As yet another example, sensors 116 may include a manifold absolute pressure (MAP) sensor 165—to sense the absolute pressure of the engine intake manifold—, intake air temperature (IAT) sensor 167—to sense the air temperature of the engine intake manifold—, and/or a manifold air flow (MAF) sensor 168—to sense the air flow of the engine intake manifold—, with these aforementioned sensors located in the intake passage of the engine intake manifold. Continuing with another example, sensors 116 may include a temperature sensor 136, located in the fuel vapor canister, to sense the temperature of the fuel vapor canister. Finally, sensors 116 may include a hydrocarbon sensor, located in the fuel vapor canister, to sense the amount of hydrocarbons located in the fuel vapor canister.

The controller 112 employs various actuators of FIG. 1 to adjust engine operation based on the received signals, such as those examples given above. Controller 112 may further include instructions stored in a memory of the controller. For example, adjusting the injection of fuel may include adjusting an actuator of a fuel injector 166 to adjust fuel injection. As another example, adjusting an air flow through an intake passage of an engine intake manifold may include adjusting an actuator of a throttle 162 to adjust the air flow. As another example, adjusting a venting of a fuel tank with the atmosphere may include adjusting an actuator of a fuel tank isolation valve (FTIV) 153 to adjust the venting of the fuel tank. As yet another example, adjusting fuel pumped through a fuel system may include adjusting an actuator of a fuel pump 121 to adjust the fuel pumped through a fuel system. Continuing with another example, adjusting a fuel cap locking mechanism may include adjusting an actuator of a refueling lock 145 to adjust the fuel cap locking mechanism. Continuing with another example, adjusting a venting of a fuel tank may include adjusting actuators of a grade vent valve (GVV) 187, a grade vent valve (GVV) 185, and a fuel tank vent valve (FTVV) 183 to adjust the venting of a fuel tank. As yet another example, adjusting a flow of vapors purged through a purge line 128 may include adjusting an actuator of a canister purge valve (CPV) 161 to adjust the flow of vapors purged through a purge line. As yet another example, adjusting a flow of fuel vapors vented to the atmosphere may include adjusting an actuator of a canister vent valve (CVV) 129 to adjust the flow of fuel vapors vented to the atmosphere. Additionally, the controller may send signals to the wave generator to adjust frequency and/or intensity of the waves generated by the wave generator based on distribution of fuel vapors within the canister, where the distribution may be determined by the controller based on outputs from one or more temperature sensors positioned within the canister. Example control routines are described herein with regard to FIG. 1.

Turning now to FIGS. 2-3, these figures show example embodiments of a canister that may include an ultrasonic wave generator, configured to be installed within an emission control system, such as emission control system 151 including canister 122 depicted in FIG. 1.

FIG. 2 shows an example carbon canister 122 including one or more temperature sensors used to monitor loading and purging of hydrocarbons based on temperature changes in the canister. Canister 122 includes an ultrasonic wave generator 297 coupled to the outside wall of the canister. The ultrasonic wave generator 297 may be used to emit wave frequencies adjusted to target and heat hydrocarbons in canister 122. It should be understood that, though FIG. 2 shows ultrasonic wave generator 297 coupled to canister 122 below a vent line 127, in other examples an ultrasonic wave generator may be located in any number of positions in relation to the canister.

Continuing with FIG. 2, canister 122 includes an adsorbent 204, e.g., activated charcoal, which is used to adsorb fuel vapors from the fuel tank. For example, canister 122 may be coupled to fuel tank 120 via vapor recovery line 131. Canister 122 may be put in communication with the atmosphere via aforementioned vent line 127. Purge line 128 couples the canister to an intake 123 of the engine for purging fuel vapor stored in the canister as described above. In some examples, canister 122 may include a dividing element 210 which partially divides the interior of the canister into a first chamber 208 and a second chamber 212. The first chamber 208 and the second chamber 212 are coupled together so that vapors can travel through the chambers.

In a refueling event, vapors flow from the fuel tank 120 via vapor recovery line 131, travel through the canister from the vapor recovery line 131 through first chamber 208 and then through second chamber 212 toward the vent 127 along a direction indicated by arrows 214. The arrows 214 illustrate a vapor path through the adsorbent 204 in the canister from the vapor recovery line 131 towards the vent line 127 so that vapor recovery line 131 is positioned upstream of the vapor flow and vent line 127 is positioned downstream of the vapor flow.

In a purging event, air is vented from the atmosphere via vent line 127 and travels through the canister from the vent line 127 through second chamber 212 and then through first chamber 208 toward a purge line 128 along a direction indicated by arrows 216. The arrows 216 illustrate a vapor path through the adsorbent 204 in the canister from the vent line 127 towards the purge line 128 so that vent line 127 is positioned upstream of vapor flow and purge line 128 is positioned downstream of vapor flow. It should be understood that, though FIG. 2 shows a dividing element 210 used to create a vapor flow path through the canister, in other examples canister 122 may not include a dividing element or may include other features to create one or more vapor flow paths.

In some examples, canister 122 may only include a single temperature sensor or thermocouple used to monitor hydrocarbon loading as described below. For example, canister 122 may only include temperature sensor TC1 and may not include any other temperature sensors. During a refueling event, temperatures in the canister may initially rise due to an exothermic reaction associated with vapor adsorption. However, as more fuel is dispensed into the fuel tank, portions of the canister may become saturated so that the vapor flowing through the canister cools the adsorbent in the canister leading to an initial decrease in temperature in the canister. At the end of refueling, vapor diffusion from downstream portions of the adsorbent in the canister may cause the temperature to again increase in the canister at a temperature inflection point. In this example, the single temperature sensor, e.g., TC1, may be used to determine a cool down duration from the initial temperature decrease to the inflection point where the temperature in the canister switches from decreasing to increasing. As described below, this cool down duration may be used to infer an amount of hydrocarbons added to the carbon canister during a loading event. An approximate estimate of the hydrocarbon storage distribution in the carbon canister may be determined from the temperature sensor, which in turn may be used by the controller to determine the frequency at which to set the ultrasonic wave generator during a purge event. Further detail with regard to adjusting the frequency in accordance to the hydrocarbon canister load is provided below.

In other examples, canister 122 may include a plurality of temperature sensors at different depths within the canister. For example, canister 122 may include temperature sensors or thermocouples TC1, TC2, TC3, TC4, TC5, and TC6 at different points within canister 122 along the vapor paths indicated by arrows 214 and 216. It should be understood that, though FIG. 2 shows six temperature sensors in the canister, various numbers of temperatures sensors may be included in the canister at different locations. For example, a first temperature sensor TC1 may be included at a first distance 232 from vapor recovery line 131 within canister 122, a second temperature sensor TC2 may be included at a second distance 234 greater than first distance 232 from vapor recovery line 131 within canister 122, a third temperature sensor TC3 may be included at a third distance 236 greater than second distance 234 from vapor recovery line 131 within canister 122, a fourth temperature sensor TC4 may be included at a fourth distance 238 greater than third distance 236 from vapor recovery line 131 within canister 122, etc. The distance from a sensor to a vapor load port may be used by the controller (not shown in FIG. 2) to adjust the frequency emitted by the ultrasonic wave generator. Further detail regarding the adjustment of frequency based on sensor location is shown in FIG. 7.

During a refueling event, the canister adsorbent traps hydrocarbons as fuel vapor flows past the temperature sensors along the vapor path. The time duration from an initial temperature increase in the first temperature sensor TC1 to a temperature inflection point as measured by the most downstream responding temperature sensor may be used by the controller to infer a hydrocarbon storage distribution in the canister. In this example, an increased amount of hydrocarbons adsorbed by the adsorbent 204 may lead to a more downstream temperature sensor responding. The initial loading of the canister, e.g., the amount of fuel vapor stored in the canister when the refueling event begins, may affect how far downstream temperature sensors will react. Further detail regarding the temperature response of the thermocouples during a refueling event may be found in FIG. 6.

Conversely, during a purge event, ultrasonic waves can be used to quickly release hydrocarbons in different locations of the canister. By adjusting the frequency of the ultrasonic waves, the waves can target different spatial positions within the canister for quick release of stored hydrocarbons. Further information detailing the adjustment of frequency over time to target hydrocarbons in a purge event is shown in FIG. 3.

When targeted, the molecules in the hydrocarbons may vibrate more rapidly, producing friction and increasing the temperature of the surrounding environment (e.g., carbon adsorbent). As stated in FIG. 1, when the hydrocarbons desorb from the activated carbon (e.g., carbon saturated with HCs), the carbon temperature cools down. When the temperature does not change, i.e., the temperature stabilizes, the adsorbent in that area may be considered free of hydrocarbons. Hence, the ultrasonic wave energy may affect how temperature sensors will react. This temperature information can then be used by the controller to infer the loadings at different portions of the canister in real time. In one example of FIG. 2, an ultrasonic wave generator 297 may generate wave frequencies to target and release the hydrocarbons trapped in adsorbent 204. The time duration from an initial temperature increase in the first temperature sensor TC1 to a point of stabilization in TC1 temperature may be used by the controller to infer the hydrocarbons have been sufficiently purged from that area of canister 122. Further detail regarding the thermocouple response during a hydrocarbon purging event may be found in FIG. 7.

FIG. 3 depicts the carbon canister incorporated in a PHEV and utilizing an ultrasonic wave generator during a purging event. For simplicity, the numbers for the components from FIG. 1 have remained the same. In this example, the canister 122 contains a "purge" side 303 and a "vent" side 305. An ultrasonic wave generator 397 is positioned on the "purge" side 303 of the canister 122. In this example, the loading state of the canister is approximated with an overall percentage value. The percentage value may be mapped to storage at defined regions of the canister assuming a uniform loading and one:one mapping of storage with location. For example, if it is determined that the canister is loaded to 50% capacity, then the controller can further estimate that the left half in FIG. 3 (being a first region) is 100% loaded and the right half (being a second region) is unloaded with hydrocarbons. The frequency of the ultrasonic generate and/or purge valve operation and/or fuel injection can then be adjusted during purging based on the loading percentage and further adjusted, if desired, based on the distribution of the HC loading along the width of the canister. It should be understood that, though FIG. 3 assumes a uniform loading and one:one mapping of storage with location, in other examples the loading of the canister may not be uniform across the width of the canister. For example, a canister may load from a vent side to a purge side, with the vent side filling more quickly with vapors than the purge side. In another example, a canister may load from a purge side to a vent side, with the purge side filling more quickly with vapors than the vent side.

When purge conditions are met, a controller (such as controller 112 of FIG. 1) receives a signal containing information regarding the amount of hydrocarbons currently stored in the carbon canister. Based on that information, the controller sets a wave frequency for the ultrasonic wave generator 397. The frequency is determined by the distribution of hydrocarbons along the length of the canister 122. Controlling the frequency of the ultrasound can target the areas of the canister that will be heated. Low frequency (20-40 kHZ) waves penetrate whereas high frequency waves attenuate. Therefore, hydrocarbons stored closer to the "vent" side 305 of the canister, release more efficiently at lower wave lengths. By comparison, hydrocarbons stored closer to the "purge" side 303 of the canister release more efficiently at higher wavelengths.

A scale 307 is used to identify the loading state of the canister as approximated with an overall percentage value. Based on scale 307—set at 0% to 100%—, the distribution of fuel vapors within the canister, based on canister load, is determined to be approximately 80% full. From this, responsive to commencement of purging operation, the wave generator 397 is set to an estimated first frequency based on a distance to the outer perimeter of the fuel vapor distribution, for example proportionally based on the distance. Thus, the frequency is set to target a right region of the canister (as viewed in FIG. 2). As the purging operation continues, the controller continues to estimate loading as the fuel vapors in the outer perimeter are purged from the right vent side 305. From this, the distribution of vapors along the outer perimeter becomes increasingly closer to the left purge side 303 as the hydrocarbons are released from the activated carbon. At a later time, the loading is determined to be approximately 50%. Responsive to this determination, the frequency is adjusted to a second, higher frequency. That is, the frequency is set to target a central region of the canister. As the purging operation continues, the controller continues to estimate loading and at a still later time determined that the loading is 25%. Responsive to this determination, the frequency is adjusted to a third frequency targeting a left-side region of the canister. In this way, the fuel vapors are desorbed from the canister starting from where the density of the vapors are the greatest, and the method includes adjusting the frequency as the waves move towards regions of the canister containing fewer vapors.

In this way, the heat produced by the ultrasonic wave generator 397 may be focused to target the hydrocarbons in different regions over time during the purging operation and not only are hydrocarbons release in a shorter time and/or to a greater degree, but the purged portions of the canister are not subject to excess heat exposure.

FIGS. 2-3 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Turning to FIG. 4, a flowchart for an example method 400 for refueling operation of a vehicle based on a request from the engine operator is shown. Specifically, a refueling routine 400 incorporates the output of various sensors to determine the hydrocarbon canister load at the end of refueling.

Routine 400 may carried out by a combination of instructions executed by and stored in memory of a controller, such as controller 112 of FIG. 1, and various sensors and actuators. The controller may employ engine actuators of the engine system, and various valves described in FIG. 1 to adjust engine operation as well as purging operation, according to the routine. It will be noted that the controller may carry out certain parts of routine 400 whereas other parts of routine 400 may occur due to adjustments to the valves, existing hardware, etc. The controller may employ engine actuators of the engine system to adjust engine operation, according to the methods described herein.

Method 400 begins at 405 and includes evaluating current operating conditions. Operating conditions may be estimated, measured, and/or inferred, and may include one or more vehicle conditions, such as vehicle speed, vehicle location, etc., various engine conditions, such as engine status, engine load, engine speed, A/F ratio, etc., various fuel system conditions, such as fuel level, fuel type, fuel temperature, etc., various evaporative emissions system conditions, such as fuel vapor canister load, fuel tank pressure, etc., as well as various ambient conditions, such as ambient temperature, humidity, barometric pressure, etc.

Continuing at 410, method 400 includes indicating whether a refueling event has been requested. For example, a refueling request may comprise a vehicle operator depression of a refueling button on a vehicle instrument panel in the vehicle or at a refueling door. In some examples, a refueling request may comprise a refueling operator requesting access to a fuel filler neck, for example, by attempting to open a refueling door, and/or attempting to remove a gas cap.

If at 410, a refueling event has not been requested, method 400 proceeds to 415. At 415, method 400 includes indicating whether purge conditions have been met. Purging conditions may be confirmed based on various engine and vehicle operating parameters, including an amount of hydrocarbons stored in canister 122 being greater than a threshold and further based on a distribution of the canister loading, the temperature of an emission catalyst being greater than a threshold temperature, fuel temperature, the number of engine starts since the last purge operation (such as the number of starts being greater than a threshold number), a duration elapsed since the last purge operation, fuel properties, and various others. An amount of fuel vapors stored in the fuel system canister may be estimated based on a learned vapor amount/concentration at the end of a previous purging cycle. The amount of fuel vapors and the distribution of the vapors stored in the fuel system canister may be further estimated based on engine and vehicle operating conditions including a frequency of refueling events and/or frequency and duration of previous purging cycles, as well as temperature sensor responses as described herein. In one example, purging conditions include purging responsive to an overall loading percentage of the canister and/or whether one or more regions is loaded greater than a threshold amount.

If purging conditions are not confirmed and not met at 415, method 400 progresses to 419. At 419, method 400 includes maintaining current engine, evaporative emissions system and fuel system status. Method 400 may then end. If purging conditions are confirmed and met at 415, method 400 progresses to 417. At 417, purging the evaporative emissions system of the vehicle may proceed as described by the method detailed in FIG. 5. Method 400 may then end.

If at 410, a refueling met has been requested, method 400 proceeds as described below. At 420, the engine may be turned off to proceed with the refueling event. At 425, purging operations may be disabled, for example, by (temporarily) maintaining the CPV in a closed position. The refueling request can then proceed. In the case of plug-in hybrid electric vehicles (PHEV), the steps following a refueling request may include depressurization of a fuel tank. The internal combustion engine of a PHEV may not operate for a prolonged period of time. In such systems, the fuel tank may be sealed and at a relatively high pressure. An automatic lock of the fuel cap is provided. Before refueling, the operator presses a dashboard button and, in response, the fuel tank is vented through the carbon canister to reduce fuel tank pressure. When a fuel tank pressure sensor indicates that the fuel tank pressure has fallen to a predetermined level, the fuel cap unlocked.

At 430, the FTIV (e.g., valve 153 in FIG. 1) may be opened and the CVV (e.g., valve 129 of FIG. 1) may be maintained open to vent the fuel tank. Herein, by opening the vapor line between the fuel tank side and the canister side of the fuel vapor circuit, pressure in the fuel tank may be relieved. For example, if a high pressure exists in the fuel tank, air and fuel vapors may flow from the fuel tank through the vapor line and into the canister. In another example, if a vacuum exists in the fuel tank, air may flow from the canister through the vapor line and into the fuel tank. In both examples, pressures of the fuel tank and the canister may go toward equilibrium, such that the fuel tank may be safely and easily opened.

At 435, it may be determined whether the absolute value of the fuel tank pressure is below a predetermined threshold. If so, at 445, refueling may be enabled. If the absolute value of the fuel tank pressure is greater than threshold, the controller may delay opening of the refueling door in command 440, until the fuel tank pressure falls below threshold. The controller may enable refueling by commanding a refueling door to open, for example, by de-energizing a solenoid in the refueling door to enable door opening.

Continuing at 450, method 400 includes monitoring fuel pressure and fuel level during refueling of the vehicle. Monitoring fuel pressure and level may include the control system receiving information regarding the vapor pressure and level of fuel stored in the fuel tank via a fuel tank pressure transducer and a fuel level indicator, either continuously or at predetermined intervals over the duration of the refueling event. The vehicle operator may then have access to the refueling line and fuel may be pumped from an external source into the fuel tank until refueling is determined to be complete at 455. Because the FTIV may remain open during the refueling operation, refueling vapors may flow through the vapor line and into the carbon canister for storage. Until refueling is complete, refueling operations may be maintained at 460.

If refueling is completed at 455, for example based on input from the fuel level indicator, the refueling door may be closed at 465, for example by energizing the refueling door solenoid. In response to refueling door closing, at 470, the FTIV and CVV may be closed in thereby ensuring that refueling vapors are stored in the canister side of the fuel vapor circuit. Upon closing the FTIV, a spike in pressure occurs indicating the end of a refueling event. After closure of the FTIV, method 400 proceeds to 475 to determine an estimated total loading state of the canister and/or an estimate of hydrocarbon storage distribution based on the output of thermocouple sensors (e.g., sensors 136 in FIG. 1). In alternate embodiments, the load added to the canister may be determined by a plurality of hydrocarbon sensors. Further details and examples for determining canister loading are described herein, including with regard to FIG. 5.

Upon completion of 475, method 400 proceeds to 480. At 480, an estimated hydrocarbon load and/or distribution along with the level of fuel remaining and fuel pressure in the tank is indicated to the vehicle system controller. Therein, the refueling routine may be concluded. Thus, refueling may be enabled when fuel tank pressures are determined to be within a safe range, and coordination of refueling with purging may be achieved.

Turning to FIG. 5, a flowchart for an example method 500 for purging a vehicle is shown. Specifically, method 500 employs an ultrasonic wave generator to target fuel vapors trapped in the canister wherein the frequency of the waves is adjusted responsive to the distribution of hydrocarbons along the length of the canister.

Method 500 will be described with reference to the systems described herein and shown in FIGS. 1-3, though it should be understood that similar methods may be applied to other systems without departing from the scope of this disclosure. Instructions for carrying out method 500 and the rest of the methods included herein may be executed by a controller (such as controller 112 shown in FIG. 1) based on instructions stored on a memory of the controller and in conjunction with the sensors and actuators of the engine system, such as the sensors described above with reference to FIGS. 1-3. For example, the controller may employ engine actuators of the engine system to adjust engine operation, according to the methods described below.

Method 500 begins at 501 and includes evaluating current operating conditions. Operating conditions may be estimated, measured, and/or inferred, and may include one or more vehicle conditions, such as vehicle speed, vehicle location, etc., various engine conditions, such as engine status, engine load, engine speed, A/F ratio, etc., various fuel system conditions, such as fuel level, fuel type, fuel temperature, etc., various evaporative emissions system conditions, such as fuel vapor canister load, fuel tank pressure, etc., as well as various ambient conditions, such as ambient temperature, humidity, barometric pressure, etc.

Continuing at 505, method 500 includes determining whether a refueling event has occurred prior to the current operating condition without a full purge therebetween. For example, an indication of a recent refueling event may be determined in response to a vehicle controller receiving an output of information containing a hydrocarbon canister load. If an output is not received, it may be determined that a refueling event did not just occur.

If a refueling event did not occur, method 500 proceeds to 510. At 510, the hydrocarbon canister load may be compared to a threshold. For example, the determined percentage loading (% TC) from FIG. 4 may be compared to a threshold. The % TC may indicate a percentage of hydrocarbons in the canister based on the response of temperature sensors over time. The percentage may represent a comprehensive amount of hydrocarbons present. As an example, if a canister is approximately 50% full of hydrocarbons—25% are found at a front end of the canister, 25% are found at a back end of the canister—the % TC is approximately 50%. As another example, if a canister is approximately 50% full of hydrocarbons—49% are found at a front end of the canister, 1% are found at a back end of the canister—the % TC is still approximately 50%, except that in this second case the frequency of the generator may be adjusted differently over the purge cycle than the first case (e.g., to target the front end to a greater extent than the back end as compared to the first case), even though in both cases the same overall percentage loading is present. Further details and examples for determining canister loading are described herein, including with regard to FIG. 6. From this, the % TC may be compared to a threshold and method 500 may continue. If the loading percentage is less than a minimum threshold, a full purge has been obtained and method 500 may continue to 550. At 550, the purge is completed and method 500 may end. If the percentage is above a threshold, method 500 may continue to 512.

At 512, an initial frequency and/or amplitude of the ultrasonic generator is set based on the percent loading and/or the distribution of the loading among different regions of the canister. In one example, the percent loading of the canister may be the % TC that was above the threshold, as described above. The % TC may represent an estimated loading state of the canister. From this, the frequency may be adjusted responsive to an estimated loading state of the canister prior to the commencement of purging. In another example, the distribution of the loading among different regions of the canister may be the amount of hydrocarbons in different spatial locations throughout the canister. For example, if a first half of the canister is indicated to be fully loaded via the thermocouple responses in that region of the canister, then the frequency and/or amplitude are adjusted to target the first half region of the canister. This allows the controller to set the ultrasonic generator to a frequency specific to the current canister load of hydrocarbons, thus reducing unnecessary heating of the canister. From this, the frequency is adjusted by the controller communicating with the generator responsive to an estimate of hydrocarbon storage distribution along a length of the canister as determined by the controller from sensed and/or other determined data. As a result, an initial frequency and/or amplitude of the ultrasonic generator is set based on the percent loading and/or the distribution of the loading among different regions of the canister.

At 514, the purge is initiated. A canister vent valve (e.g., CVV 129 of FIG. 1) coupled between the fuel canister and atmosphere is opened, allowing for fresh air to enter to canister. Simultaneously, a canister purge valve (e.g., CPV 161 of FIG. 1) coupled between the engine intake and the fuel canister is opened, allowing for intake manifold vacuum to be applied to the fuel canister. This configuration facilitates desorption of stored fuel vapors from the adsorbent material in the canister, regenerating the adsorbent material for further fuel vapor adsorption while the generator generates ultrasonic waves at the selected frequency and amplitude. As the purge proceeds, method 500 continues to 516.

At 516, the frequency of the ultrasonic wave generator may be adjusted during purging responsive to a plurality of temperature sensors positioned in the canister. As explained above, targeted heating of the hydrocarbons within the canister may temporarily lead to an increase in temperature of the targeted zone. Following an initial heating from the generator, the activated carbon cools down as the hydrocarbons are desorbed. When the temperature is stable, the area is indicated to be free of hydrocarbons. From this, if the response of the thermocouples in that area is determined to be stable, the frequency is adjusted to target a different spatial location within the canister. The changes in temperature response and subsequent adjustment of wave frequency may be further determined by temperature-based variables described herein.

For example, if the response of the thermocouples estimates a greater distribution of hydrocarbons towards one end (e.g., more towards a front end of the canister than a back end), the frequency is adjusted to emit ultrasonic waves along the end of the canister with the heavier load. This may be done by setting a wave frequency to target the load based on its location. In this way, the frequency is adjusted responsive to an estimate of hydrocarbon storage distribution along the length of the canister.

Furthermore, the response of the thermocouples may estimate a distribution of hydrocarbons in higher concentrations relative to each other. In a situation with limited purge opportunity, the location of the canister containing the highest concentration of hydrocarbons may be targeted first at the initiation of a purging event, thus maximizing the effectiveness of the limited time available for the purge event. From this, the frequency and/or amplitude of ultrasonic waves applied to a canister may be adjusted based on relative canister loading in different regions of the canister.

As another example, the frequency may be further adjusted responsive to differences between the temperature sensor readings, and differences in the profile of the temperature sensors over time. For example, the ultrasound generator may be releasing a frequency set to target a location encompassing temperature sensors TC1-TC4. In this example, the responses of TC1-TC4 are as follows: TC1 is not changing, e.g., the temperature response is stable, TC2 is not changing, TC3 is in fluctuation, e.g., the temperature response is increasing or decreasing, TC4 is not changing. From this, the differences between the readings may be used to adjust the ultrasonic frequency. As described above, when the temperature is stable (e.g., changing by less than 10% over a monitored duration for stability), the area is indicated to by free of hydrocarbons. Based on this example, the ultrasonic frequency is adjusted to target a location surrounding TC3, as the area is not indicated to be free of hydrocarbons. The ultrasonic waves may still contribute to residual purging of hydrocarbons in the surrounding area, but the wave frequency is targeted at TC3. Further, the profile of the temperature sensors over time may change. Continuing with the same example, if TC3 is fluctuating (e.g., not stable), this may be interpreted as a temperature increase or decrease. If the temperature is increasing, the ultrasound generator is actively targeting the hydrocarbons, inducing molecular vibration and frictional heat. Over time, the profile of TC3 may change as hydrocarbons desorb from the activated carbon. With a subsequent decrease in temperature, the intensity in frequency set to target TC3 may be adjusted until the area is determined to be free of hydrocarbons. The frequency is adjusted responsive to temperature sensor profiles in the canister during purging. As such, the frequency may be adjusted based on the differences between the temperature sensor readings and differences in the profile of the temperature sensors over time.

In a similar manner, the frequency may be adjusted responsive to ambient temperature and/or a temperature profile of components adjacent to the canister. For example, if a component such as a heater core (not shown in FIGS. 1-2) is located near the canister, it may emit heat. The additional heat, derived from the heater core, may inadvertently release trapped HCs in the canister. From this, the frequency may be adjusted to target an area outside of the heater core range. In this way, heat distributed by the generator is diverted and applied elsewhere.

Further, if heat outside of the canister is sufficient, the ultrasonic wave generator may be deactivated to save electrical energy. For example, based on feedback from air temperature sensors located in the canister vent line, if the air flowing through the CVV is hot enough to release trapped HCs at a rate pre-determined to be sufficient for a purge event, the ultrasonic generator may be shut off. In this way, the ultrasound generator may be deactivated responsive to ambient conditions.

Alternatively, and independent of temperature response, the deactivation of the ultrasound generator may be prompted in response to a supply of available battery power. For example, in a carbon canister incorporated in a PHEV (e.g., canister 122 of FIG. 3), the vehicle battery may be determined insufficient to support an impending and/or occurring purge event based on a threshold. In one example, the threshold may be a threshold charge the battery holds to maintain operation of the vehicle. In this way, the waves are discontinued during a purge event responsive to a battery state of charge.

As described in detail above, the response of the thermocouples change as the load of the hydrocarbons in the canister change over time. From this, the frequency of the waves may be adjusted throughout a single continuous purge duration based on these conditions. For example, responsive to a loading state as indicated by temperature sensors, the frequency may begin at a low setting, followed by an adjustment to a high setting as the purge continues. This may occur during a single continuous purge duration, responsive to a canister having a first region (e.g., vent side 305 described in FIG. 3) with a first loading higher than a second load of the second region (e.g., purge side 303 described in FIG. 3). During a first purging event, the ultrasonic waves may generate a first, lower frequency to purge the first region and then generate a second, higher frequency to purge the second region. In an alternate example, responsive to temperature sensors, the frequency may begin at a high setting, followed by an adjustment to a low setting as the purge continues. This may occur during a single continuous purge duration, responsive to a canister having the aforementioned first region with a third loading lower than a fourth loading of the aforementioned second region. Thus, during a second purging event, the ultrasonic waves may generate a third, higher frequency to purge the second region and then generate a fourth, lower frequency to purge the first region. Ultimately, the frequency of the ultrasonic waves may be initially set responsive to a region containing the highest distribution of hydrocarbons and then adjusted to desorb lower concentration regions, thereby reducing unnecessary canister heating. Therefore, the frequency of the waves emitted by the ultrasonic generator may be adjusted over time during a single continuous purge, the adjusting including during a first purging event, generating a first frequency and then a second higher frequency; and the adjusting further including during a second purging event, generating a third frequency and then a fourth, lower frequency.

Continuing with method 500, at 517, engine fueling is adjusted based on an amount of fuel vapors ingested. Specifically, the amount of fuel injected into the engine cylinders is adjusted based on the quantity of fuel vapors received from the fuel system canister. For example, fueling may be decreased as purged vapor concentration increases so as to maintain combustion at stoichiometry. The amount of vapors purged may be based not only the temperature sensor responses, but also estimated in a feed forward manner based on the ultrasonic generator amplitude and frequency and feedback from exhaust oxygen sensors indicating potential air-fuel ratio disturbances generated by variations in the amount of hydrocarbons in the purge flow. As one example, when the frequency is adjusted from one region (e.g., that has been sufficiently heated and purged to another region that has significantly more stored hydrocarbons), the fuel injection may be proactively adjusted to decrease in response to the change in ultrasonic generator targeting location/region as indicated by the change in frequency and/or amplitude. In detail, during a first purging event, the ultrasonic generator may generate a first frequency from one region and then adjust to a second, higher frequency for a second region. In response, fuel injection may be reduced, as described above, if the flow of vapors from the canister is above a threshold based on feedback from exhaust oxygen sensors. Alternatively, fuel injection may be increased if the flow of vapors from the canister is below a threshold. The threshold may be a threshold amount of fuel vapors flowing from the canister needed to maintain stoichiometric air-fuel ratio. In this way, fuel injection may be adjusted in response to wave frequency throughout a single purge event. Further still, during a second purging event, the ultrasonic generator may generate a third frequency from one region, and then adjust to a fourth, lower frequency for a second region. In response, the fuel injectors may be reduced or increased based on feedback from exhaust oxygen sensors. In this way, the fuel injection may be adjusted responsive to exhaust gas sensors and further responsive to the first, second, third, and fourth frequencies. Additional information regarding the adjustment of fueling during a purge event may be found in FIG. 7.

Additionally, at 519 the routine adjusts the purge valve opening amount based on operating conditions. For example, the amount of purge flow, regulated by valve 161, may be adjusted responsive to a purge duration length, as well as based on feedback from exhaust oxygen sensors indicating potential air-fuel ratio disturbances generated by variations in the amount of hydrocarbons in the purge flow. In one example, valve 161 may be adjusted in a feed-forward manner responsive to the ultrasound frequency generated in the canister, and further responsive to estimated loading and distribution of the canister (for example determined based on the temperature profile and/or time variation of temperatures with the canister). In response to a change in the ultrasound frequency changing targeting from a first region with less vapors to another region with more vapors, opening of the purge valve 161 may be decreased, at least temporarily, to reduce the impact of an increase in hydrocarbons, even in coordination with a feed-ward reduction in fuel injection, in order to maintain combustion air-fuel ratio at a desired, e.g., stoichiometric, air-fuel ratio. In another example, during a first purging event, the ultrasonic generator may generate a first frequency from one region and then adjust to a second, higher frequency for a second region. In response, opening of the purge valve may be increased if the flow of vapors from the fuel canister is below a threshold based on feedback from exhaust oxygen sensors. Alternatively, as mentioned above, opening of the purge valve may be decreased if the flow of vapors from the fuel canister is above a threshold. The threshold may be a threshold amount of fuel vapors flowing from the canister needed to maintain stoichiometric air-fuel ratio. Further, during a second purging event, the ultrasonic generator may generate a third frequency from one region, and then adjust to a fourth, lower frequency for a second region. In response, opening of the purge valve may be increased or decreased based on feedback from the exhaust gas sensors. In this way, the purge valve may be adjusted responsive to a first, second, third, and fourth frequencies. Method 500 then continues to monitor the canister loading and at 540 if sufficient purging has occurred continues to 540. Otherwise, the routine continues purging. At 550, the purge may end. The CPV is closed at 555, the canister load is updated in the controller's memory at 560, and the method 500 may end. In alternate examples, even if the canister load is below the threshold load, during engine operation, canister purging may be opportunistically continued with the CPV open until the canister is fully purged. Herein, the limited engine operation time of a hybrid vehicle may be advantageously used to regenerate the canister whenever possible.

Returning to 505, when the answer is YES, the routine continues to 520. At 520, an initial wave frequency of the ultrasonic generator is set based on the refueling conditions, including an amount of fuel added, a final fill level, and an estimate of the amount of hydrocarbons loaded into the canister. As explained above, after a refueling event occurs, the controller receives an output of information containing the hydrocarbon canister load. Before the purge proceeds, the controller may set the ultrasonic generator to a frequency specific to the current canister load of hydrocarbons. Thus, the frequency is adjusted responsive to a fuel refilling operating condition, wherein the fuel refilling condition is an amount of fuel added during an immediately preceding refilling before the purge duration. The routine then continues to 514 as discussed above.

FIG. 6 shows a graphical example depicting temperature changes during refueling, as output by first, second, and third thermocouples (TC1, TC2, and TC3), using methods described herein (such as method 400 of FIG. 4) and as applied to the systems described herein (such as the systems of FIGS. 1 and 2). A threshold for each thermocouple (T1, T2, and T3), indicates a level in which the area is saturated with hydrocarbons. Specifically, graph 600 indicates a level of fuel added to a fuel tank at plot 605, an estimated percentage hydrocarbon loading of the canister at plot 610 (as indicated from an output of a plurality of temperature sensors in one example), the position a fuel isolation valve at plot 615, the temperature output by TC1 at plot 620, the temperature output by TC2 at plot 625, the temperature output by TC3 at plot 630, and whether a refueling event is indicated to be complete at plot 635. Although only three thermocouples are used in this graphical example, it should be understood that another number of temperatures sensors may be included in the canister.

At a time $t_0$, in response to a refueling request (not shown in FIG. 6), a fuel tank isolation valve may be commanded open (plot 615). By commanding open the FTIV (while maintaining open or commanding open a canister vent valve), the fuel tank may be depressurized prior to commencing refueling. As refueling has not yet been initiated, the fuel level is stable (plot 605), the canister load of hydrocarbons is stable (plot 610), the temperatures of TC1 (plot 620), TC2 (plot 625), and TC3 (plot 630) are stable, and refueling is not complete (plot 635).

Between times $t_0$ and $t_1$, the FTIV is open and refueling may begin. As refueling begins, the fuel level (plot 605) increases and the canister load of hydrocarbons increases (plot 610). As previously described in FIG. 2, as fuel vapor enters through the vapor vent line 131 and continues along vapor path 214, it flows past the thermocouples (e.g., TC1-TC6). Continuing with graph 600, the temperature response of sensor TC1, e.g., downstream of vent line 131, begins to increase between times $t_0$ and $t_1$. At this point in time, the vapor has not proceeded downstream of TC1. From this, there is no temperature response in TC2 (plot 625) or TC3 (plot 630) and refueling is not complete (plot 635).

At time $t_1$, the canister load (plot 610) continues to rise in response to fuel vapor loading as the fuel level continues to rise (plot 605). The temperature response of TC1 (plot 620) continues to increase. Fuel vapors start to become adsorbed by adsorbent adjacent to sensor TC2 downstream of TC1, causing the temperature as measured by sensor TC2 to increase (plot 625). At this point in time, the vapor has not proceeded downstream of TC2. There is no temperature response in TC3 (plot 630) and refueling is not complete (plot 635).

At time $t_2$, the canister load (plot 610) continues to rise as the fuel level continues to rise (plot 605). The temperature response of TC1 (plot 620) and TC2 (plot 625) continues to increase. Further, fuel vapors start to become adsorbed by adsorbent adjacent to sensor TC3 downstream of TC2, causing the temperature as measured by sensor TC3 to increase (plot 625).

Between times $t_2$ and $t_3$, more hydrocarbons are loaded into the canister (plot 610) as more fuel is dispensed into the fuel tank (plot 605). At this time, portions of the canister may start to become saturated. When saturation of the adsorbent surrounds TC1 (plot 620), a threshold T1 is reached. The vapor flowing through the canister cools the adsorbent in the canister leading to an initial decrease in temperature in the canister (plot 620). The temperature response of TC2 (plot 625) and TC3 (plot 630) continue to increase and refueling is not complete (plot 635).

At time $t_3$, the canister load (plot 610) continues to rise as the fuel level continues to increase (plot 605). The temperature response of TC1 (plot 620) continues to decline. When saturation of the adsorbent surrounds TC2 (plot 625), a threshold T2 is reached. The vapor flowing through the canister cools the adsorbent in the canister leading to an initial decrease in temperature (plot 625). The temperature response of TC3 (plot 630) continues to increase and refueling is not complete (plot 635).

At time $t_4$, the fuel level begins to plateau (plot 605) at the fuel level comprising the addition of fuel corresponding to the amount selected to add by the vehicle operator (not shown in FIG. 6). Thus, at time t5, it is indicated that the refueling event is complete (plot 635), followed by a subsequent closure of the FTIV (plot 615). With the FTIV (plot 615) as a further indication of the end of refueling, vapor diffusion from downstream portions of the adsorbent in the canister may cause a heating effect wherein the temperature again increases in the canister. The temperature response of TC1 (plot 620) and TC2 (plot 625) shows an increase as downstream portions of the adsorbent cause a heating effect. With refueling ended, the temperature response of TC3 (plot 630) is minimal, mostly unaffected by the receding vapor diffusion. At time $t_5$, the refueling event is complete.

FIG. 7 shows a graphical example depicting a temperature variation during a purge event, for the first, second, and fourth thermocouples (TC1, TC2, and TC4), using methods described herein (such as method 500 of FIG. 5) and as applied to the systems described herein (such as the systems of FIGS. 1 and 2). With reference to FIG. 2, TC4 may represent a distance 238. When the canister is approximately 80% full of hydrocarbons, it can be inferred that it is saturated up to a distance 238. The canister may be defined as 80% full at distance 238 or TC4, for the purposes of the example in this graph 700 of FIG. 7. In this way, TC2 may represent a distance 234 while TC1 may represent a distance 232. The canister may be defined as 50% full when saturated at a distribution exceeding a distance 234 and 232. Specifically, graph 700 shows whether a purge event is indicated at plot 705, a percentage at which a canister is loaded with hydrocarbons at plot 710, a wave frequency emitted by the ultrasonic wave generator at plot 715, the change in temperature output by TC1 at plot 720, the change in temperature output by TC2 at plot 725, the change in temperature output by TC4 at plot 730, and the adjustment of fuel delivered to fuel injectors at plot 735.

As described herein, the frequency emitted by the wave generator may be adjusted during purging based on the estimated canister load and/or distribution of loading. As shown in plot 710, there are two examples. A first load, approximately 80%, is indicated by a solid line. A second load, approximately 50%, is indicated by a dashed line. In this graphical example, the first and second loads represent purging events that take place independently.

In a first example of graph 700, the purge begins with a first canister load of approximately 80% (plot 710). A second example of graph 700 indicating a purge beginning with a canister load of approximately 50% will be explained in further detail to follow.

At a time $t_0$, in response to a purge request (plot 705), the estimated canister load is approximately 80%. For the purposes of this example, if it is determined that the canister is loaded to 80% capacity, then the controller can further estimate that a first region is 80% loaded and the other half (being a second region) is unloaded with hydrocarbons. The frequency generated by the ultrasonic wave generator (plot 715) is set low. As explained above, a low frequency wave targets a region farther away from the ultrasonic wave generator, generating heat at a desired distance (e.g., a distance 238 of FIG. 2). As a result, TC1 (plot 720) and TC2 (plot 725) indicate a moderate change in temperature as they are located in the canister at a distance (e.g., a distance 234 and 232 of FIG. 2) wherein the imbedded hydrocarbons are less likely to desorb when penetrated by a low wave frequency. The response of TC1 and TC2 may remain moderate, though a moderate desorption may still occur in the process. By comparison, TC4 (plot 730) indicates a greater change in temperature in response to the low frequency as the sensor is located in the canister at a distance wherein the imbedded hydrocarbons are more likely to desorb when penetrated by a low wave frequency. The fuel injection (plot 735) is adjusted in response to the fuel vapors received from the canister. Fueling may be decreased as purged vapor concentration increases so as to maintain combustion at stoichiometry.

Further in graph 700, between times $t_0$ and $t_1$, the purge request (plot 705) remains stable and the canister load (plot 710) begins to decrease as the vapor is purged. In particular, fuel vapors are preferentially desorbed at an end of the canister opposite the ultrasonic wave generator. That is, the fuel vapor concentration at the end of canister opposite the wave generator decreases more rapidly than towards the end of canister that includes the wave generator. As a low frequency wave (plot 715) continues to penetrate the canister, the change in temperature at sensors TC1 (plot 720) and TC2 (plot 725) continue to indicate a mild response. In contrast, the temperature response of TC4 (plot 730) begins to decrease. As explained above, following an initial heating from the generator, the activated carbon cools down as the hydrocarbons are desorbed. When the temperature is stable, the area is indicated to be free of hydrocarbons. Thus, the spatial position occupied by TC4 may be determined to be free of hydrocarbons. The fuel injection continues to remain low (plot 735) as the purged vapor continues to flow from the canister.

At time $t_1$, the purge request (plot 705) remains stable and the canister load (plot 710) continues to decrease as the vapor is purged. The frequency (plot 715) is adjusted in response to a decrease in vapor concentration in the canister. With the area surrounding TC4 determined to be free of hydrocarbons, the frequency may be increased to target hydrocarbons at a distance closer to the ultrasonic wave generator (e.g., a distance 234 of FIG. 2). In effect, this produces ultrasonic waves that sweep the canister, the frequency adjusted to target and purge hydrocarbons based on their spatial location. As a result, TC1 (plot 720) continues to produce a mild response, yet TC2 (plot 725) begins to experience a change in temperature. The generator heats the area to encourage hydrocarbon desorption, thus yielding an increase in temperature of TC2 (plot 725). TC4 (plot 730) is not within range of the increased wave frequency and exhibits a negligible response to the ultrasonic waves. The fuel injection continues to remain low (plot 735) as the purged vapor continues to flow from the canister.

At time $t_2$, the purge request (plot 705) remains stable, the canister load (plot 710) continues to decrease, and the frequency (plot 715) remains stable at an intermediate wave frequency. TC1 (plot 720) continues to produce a mild response, yet TC2 yields a greater change in temperature in response to the intermediate frequency. TC2 is located in the canister at a distance wherein the imbedded hydrocarbons are more likely to desorb when exposed to the recent increase in wave frequency (plot 715). TC4 (plot 730) is not within range of the increased wave frequency and exhibits a negligible response to the ultrasonic waves. The fuel injection continues to remain low (plot 735) as the purged vapor continues to flow from the canister.

Graph 700 continues from times $t_2$ to $t_3$, the purge request (plot 705) remains stable, the canister load (plot 710) continues to decrease, and the frequency (plot 715) remains stable. TC1 (plot 720) continues to produce a mild response. By comparison, the temperature response of TC2 (plot 725) begins to decrease. As explained above, the activated carbon cools down as the hydrocarbons are desorbed. When the temperature is stable, the area is indicated to be free of hydrocarbons. Thus, the spatial position occupied by TC2 may be determined to be free of hydrocarbons. TC4 (plot 730) is not within range of the increased wave frequency and exhibits a negligible response to the ultrasonic waves. The fuel injection continues to remain low (plot 735) as the purged vapor continues to flow from the canister.

At time $t_3$, the purge request (plot 705) remains stable and the canister load (plot 710) continues to decrease. With the area surrounding TC2 indicated to be free of hydrocarbons, the frequency (plot 715) may be increased to induce wave attenuation in response to hydrocarbons remaining at a distance closest to the ultrasonic wave generator. TC1 (plot 720) begins to experience an increase in temperature as TC2 (plot 725) continues to cool down. TC4 (plot 730) is not within range of the increased wave frequency and exhibits a negligible response to the ultrasonic waves. The fuel injection continues to remain low (plot 735) as the purged vapor continues to flow from the canister.

Further in graph 700, between times $t_3$ and $t_4$, the purge request (plot 705) remains stable, the canister load (plot 710) continues to decrease, and the frequency (plot 715) remains stable at a high wave frequency. TC1 (plot 720) begins to decrease as TC2 and TC4 exhibit a negligible response to the waves. The fuel injection continues to remain low (plot 735) as the purged vapor continues to flow from the canister.

At time $t_4$, the purge request (plot 705) remains stable, the canister load (plot 710) continues to decrease, and the frequency (plot 715) remains stable. TC1 (plot 720) continues to decrease as TC2 (plot 725) and TC4 (plot 730) exhibit a negligible response to the waves. Fuel injection continues to remain low (plot 735) as the purged vapor continues to flow from the canister.

Graph 700 continues from times $t_4$ to $t_5$, the purge request (plot 705) remains stable, the canister load (plot 710) continues to decrease, and the frequency (plot 715) remains stable. The response of TC1 (plot 720) becomes negligible, indicating the area is free of hydrocarbons. TC2 (plot 725) and TC4 (plot 730) continue to remain unresponsive to the high frequency waves. As a result, the vapor concentration flowing from the canister is reduced. With the canister indicating a low load (plot 710), fuel injection (plot 730) may be increased as a result so as to maintain combustion at stoichiometry.

At time $t_5$, the purge request (plot 705) is terminated as the canister load (plot 710) is determined to be minimal (i.e., near zero). In response, the (plot 715) output of the ultrasonic wave generator may be terminated as well. Sensors TC1 (plot 720), TC2 (plot 725), and TC4 (plot 730) are stable, indicating the area surrounding the sensors to be free of imbedded hydrocarbon. Fuel injection is controlled at a rate to maintain stoichiometry. At time $t_6$, the purge event may end.

Turning now to a second example of graph 700, a purge begins with a canister load of approximately 50%. At a time $t_0$, in response to a purge request (plot 705), the canister load is determined at approximately 50%. The canister load may be determined to be approximately half full. For the purposes of this example, if it is determined that the canister is loaded to 50% capacity, then the controller can further estimate that one half is 100% loaded and the other half (being a second region) is unloaded with hydrocarbons. The frequency generated by the ultrasonic wave generator (plot 715) is set to an intermediate frequency. An intermediate frequency wave may generate heat set to target a distance (e.g., a distance greater than distance 234 of FIG. 2) conducive to half full. This, in turn, prevents unnecessary portions of the canister to be heated by the generator.

At times $t_0$ to $t_1$, the purge request (plot 705) remains stable and the canister load (plot 710) begins to decrease as the vapor is purged. TC1 (plot 720) indicates a moderate change in temperature. TC1 is located in the canister at a distance (e.g., a distance 232 of FIG. 2) wherein the imbedded hydrocarbons are less likely to desorb when penetrated by an intermediate wave frequency. By comparison, TC2 (plot 725) shows a greater change in temperature in response to an intermediate frequency as the sensor is located in the canister at a distance wherein the imbedded hydrocarbons are more likely to desorb when penetrated by an intermediate wave frequency. Following an initial heating from the ultrasonic waves, the sensor response of TC2 (plot 725) may increase to a point and then begin to decrease as the carbon cools. The response of TC4 (plot 730) is negligible and unresponsive to an intermediate frequency, indicating the area is free of hydrocarbons. The fuel injection (plot 735) is adjusted in response to the fuel vapors received from the canister. Fueling may be decreased as purged vapor concentration increases so as to maintain combustion at stoichiometry.

Graph 700 continues from times $t_1$ to $t_2$, the purge request (plot 705) remains stable and the canister load (plot 710)

continues to decrease as the vapor is purged. The frequency (plot 715) is adjusted in response to a decrease in vapor concentration in the canister. With the area surrounding TC2 determined to be free of hydrocarbons, the frequency can be increased to target hydrocarbons at a distance closer to the ultrasonic wave generator (e.g., a distance 232 of FIG. 2). As a result of a high frequency, TC1 (plot 720) produces a greater change in temperature response, indicated by an initial heating of the targeted area followed by a cooling of the carbon. TC2 (plot 725) and TC4 (plot 730) are not within range of the increased wave frequency and exhibit a negligible response to the ultrasonic waves. The fuel injection continues to remain low (plot 735) as the purged vapor continues to flow from the canister.

At time $t_2$, the purge request (plot 705) is terminated as the canister load (plot 710) is indicated to be minimal (i.e., near zero). In response, the (plot 715) output of the ultrasonic wave generator may be terminated as well. The response of TC1 (plot 720) becomes negligible, indicating the area is free of hydrocarbons. TC2 (plot 725) and TC4 (plot 730) continue to remain unresponsive to the high frequency waves. As a result, the vapor concentration flowing from the canister is reduced. Fuel injection (plot 730) may be increased to maintain combustion at stoichiometry.

Finally in graph 700, between times $t_2$ and $t_6$, sensors TC1 (plot 720), TC2 (plot 725), and TC4 (plot 730) are stable, indicating the area surrounding the sensors to be free of imbedded hydrocarbon. Fuel injection is controlled at a rate favorable to maintain stoichiometry. At time $t_6$, the purge event may end. As shown in the graphs presented in FIGS. 6-7, the temperature sensors may indicate a level of saturation of hydrocarbons in the carbon canister. During a refueling event, the exothermic reaction associated with vapor adsorption in the canister takes place, leading to an increase of temperature in the canister. As carbon pellets within each partition zone of the canister adsorb hydrocarbon vapors, the temperature of the sensor disposed within that zone rises, until the carbon pellet reaches saturation. Thereafter, no further adsorption occurs, but the flow vapor across the pellets produces a cooling effect, and the corresponding thermocouple shows a decrease in temperature. Therefore, saturation of each zone of the canister appears as an inflection point in the temperature curve of that zone. By identifying inflection points in temperature trends, one can infer that the canister is substantially saturated.

By comparison, during a purge event, the endothermic reaction associated with vapor desorption in the canister takes places, leading to a decrease of temperature in the canister. However, controlling an ultrasonic wave generator for targeted heating of the hydrocarbons within the canister may temporarily lead to an increase in temperature of the targeted zone. Following an initial heating from the generator, the activated carbon cools down as the hydrocarbons are desorbed. When the temperature is stable, the area is indicated to be free of hydrocarbons. Therefore, the sensors may be used to indicate a level of saturation of hydrocarbons, allowing the controller to adjust the frequency of the ultrasonic waves to target and trap different spatial positions within the canister.

In this way, an ultrasonic wave generator may be included in a vehicle emissions control system. The ultrasonic wave generator may be directly coupled to a fuel vapor canister. Further, the frequency of the ultrasonic waves may be adjusted and applied to the fuel vapor canister, where the ultrasonic wave generator is controlled responsive to operating conditions. Further still, the frequency may be adjusted responsive to an estimate of hydrocarbon storage level and distribution along the length of the canister, determined based on output from one or more sensors positioned in the canister. As a result, the frequency may vary from low to high dependent upon the spatial position of the hydrocarbon distribution. The frequency may further be adjusted during purging responsive to the temperature of components adjacent to the canister. In addition, fuel injection may be adjusted based on the adjusted frequency so as to maintain combustion at stoichiometry. The ultrasound generator may also be deactivated responsive to over-temperature conditions, completion of purging, aborting of purging, etc.

Adjusting the frequency of ultrasonic waves from an ultrasonic generator to release hydrocarbons in different locations of the canister may address the issues of some heating approaches that otherwise use excessive electrical energy, create delays due to temperature dynamics, and neglect to isolate specific locations where hydrocarbons happen to be stored for a given set of storage and purging conditions. With the application of an ultrasonic wave generator to a fuel vapor canister, ultrasonic waves may generate heat quickly and use lower power than resistive heaters, thereby increasing an accuracy of engine control based on the outputs of temperature and hydrocarbon sensors. In addition, the waves can target different spatial positions within the canister for quicker release of stored hydrocarbons. Further, the frequency may be adjusted during a single purge event so that at different times of the purge duration, different locations of the canister are targeted for assistance in releasing hydrocarbons so that an extensive purging of the canister is achieved in a reduced time. Further still, carbon flakes from pervasive thermal cycling are reduced by controlling the frequency of the ultrasound to heat specific areas. Finally, the ultrasonic generator is positioned outside of the canister purge end, granting access for service and diagnostics. As such, the technical effect of a system including an ultrasonic wave generator positioned outside of a fuel vapor canister is increasing an accuracy of fuel vapor purge, reducing excess thermal cycling which may lead to an extension of the canister shelf life, and an accessible location for service and diagnostic purposes.

In one embodiment, a method includes adjusting a frequency and/or amplitude of ultrasonic waves applied to a fuel vapor canister of a vehicle based on an operating condition. In a first example of the method, the method further comprises wherein the frequency is adjusted responsive to an estimate of hydrocarbon storage distribution along a length of the canister. A second example of the method optionally includes the first example and further includes wherein the frequency is adjusted responsive to an estimated total loading state of the canister determined prior to commencement of the purging. A third example of the method optionally includes one or more or both of the first and second examples, and further includes wherein the frequency is adjusted responsive to a plurality of temperature sensors positioned in the canister. A fourth example of the method optionally includes one or more or each of the first through third examples, and further includes wherein the frequency is adjusted responsive to differences between the temperature sensor readings, and differences in the profile of the temperature sensors over time. A fifth example of the method optionally includes one or more or each of the first through fourth examples, and further includes wherein the frequency is first increased during the purging and then decreased during the same purge. A sixth example of the method optionally includes one or more or each of the first through fifth examples, and further includes wherein the frequency is further adjusted responsive to ambient temperature and/or a temperature profile of components adjacent to the canister. A seventh example of the method optionally includes one or more or each of the first through sixth examples, and further comprises adjusting fuel injection based on the adjusted frequency. An eighth example of the method optionally includes one or more or each of the first through seventh examples, and further comprises deactivating the ultrasound generator responsive to ambient conditions.

In a second embodiment, a method includes adjusting a frequency and/or amplitude of ultrasonic waves applied to a fuel vapor canister of a vehicle based on relative canister loading in different regions of the canister. In a first example of the method, the method further comprises wherein said adjusting includes, during a single continuous purge duration and responsive to a canister having a first region with a first loading higher than a second region, generating a first, lower frequency to purge the first region and then generating a second, higher frequency to purge the second region; and during another single continuous purge duration and responsive to the canister having the first region with a loading lower than the second region, generating a third, higher frequency to purge the second region and then generating a fourth, lower frequency to purge the first region. A second example of the method optionally includes the first example, and further includes wherein the frequency is adjusted responsive to ambient temperature. A third example of the method optionally includes one or more or both of the first and second examples, and further includes wherein the waves are discontinued during the purging responsive to a battery state of charge. A fourth example of the method optionally includes one or more or each of the first through third examples, and further includes wherein the frequency is adjusted responsive to a fuel refilling operating condition. A fifth example of the method optionally includes one or more or each of the first through fourth examples, and further includes wherein the fuel refilling condition is an amount of fuel added during an immediately preceding refilling before the purge duration. A sixth example of the method optionally includes one or more or each of the first through fifth examples, and further includes wherein the frequency is adjusted responsive to temperature sensor profiles in the canister during the purging.

In a third embodiment, a system includes a fuel system having a canister and an ultrasonic wave generator; and a controller coupled to the wave generator with memory having instructions stored therein for during a first purging event, generating a first frequency and then a second, higher frequency; and during a second purging event, generating a third frequency and then a fourth, lower frequency. In a first example of the system comprising a purge valve coupled to the canister and an engine intake, the controller further including instructions to adjust the purge valve responsive to the first, second, third, and fourth frequencies. A second example of the system optionally includes the first example, and further comprising an exhaust gas sensor coupled in an exhaust of the engine, and a fuel injector coupled to the engine, the controller further including instructions to adjust the fuel injection during purging responsive to the exhaust gas sensor and further responsive to the first, second, third, and fourth frequencies.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A downloadable software code that operates on a vehicle computer with the method comprising:

reading an operating condition of the vehicle, adjusting a frequency and/or amplitude of ultrasonic waves applied to a fuel vapor canister of the vehicle from an ultrasonic wave generator coupled to the canister based on the vehicle operating condition.

2. The method of claim 1, wherein the frequency is adjusted responsive to an estimate of hydrocarbon storage distribution along a length of the canister.

3. The method of claim 1, wherein the frequency is adjusted responsive to an estimated total loading state of the canister determined prior to commencement of the purging.

4. The method of claim 1, wherein the frequency is adjusted responsive to a plurality of temperature sensors positioned in the canister.

5. The method of claim 4, wherein the frequency is adjusted responsive to differences between the temperature sensor readings and differences in the profile of the temperature sensors over time.

6. The method of claim 1, wherein the frequency is first increased during the purging and then decreased during the same purge cycle.

7. The method of claim 1, wherein the frequency is further adjusted responsive to ambient temperature and/or a temperature profile of components adjacent the canister.

8. The method of claim 1, further comprising adjusting fuel injection based on the adjusted frequency.

9. The method of claim 1, further comprising deactivating the ultrasound generator responsive to ambient conditions.

10. A downloadable software code that operates on a vehicle computer with the method comprising:

reading an operating condition of the vehicle to determine relative canister loading in different regions of the canister, adjusting a frequency and/or amplitude of ultrasonic waves applied to a fuel vapor canister of the vehicle from an ultrasonic wave generator coupled to the canister based on the relative canister loading in different regions of the canister.

11. The method of claim 10, wherein said adjusting includes, during a single continuous purge duration and responsive to a canister having a first region with a first loading higher than a second region, generating a first, lower frequency to purge the first region and then generating a second, higher frequency to purge the second region; and during another single continuous purge duration and responsive to the canister having the first region with a third loading lower than the second region, generating a third, higher frequency to purge the second region and then generating a fourth, lower frequency to purge the first region.

12. The method of claim 10, wherein the frequency is adjusted responsive to ambient temperature.

13. The method of claim 10, wherein the waves are discontinued during the purging responsive to a battery state of charge.

14. The method of claim 10, wherein the frequency is adjusted responsive to a fuel refilling operating condition.

15. The method of claim 11, wherein the fuel refilling condition is an amount of fuel added during an immediately preceding refilling before the purge duration.

16. The method of claim 10, wherein the frequency is adjusted responsive to temperature sensor profiles in the canister during the purging.

17. A system, comprising:

a controller;

a fuel system having a canister for collecting fuel vapors and an ultrasonic wave generator coupled to the canister;

the controller coupled to the wave generator with memory having instructions stored therein for during a first purging event of the canister, generating a first frequency and then a second, higher frequency; and during a second purging event of the canister, generating a third frequency and then a fourth frequency, lower than the third frequency.

18. The system of claim 17, further comprising a purge valve coupled to the canister and an engine intake, the controller further including instructions to adjust the purge valve responsive to the first, second, third, and fourth frequencies.

19. The system of claim 18, further comprising an exhaust gas sensor coupled in an exhaust of the engine, and a fuel injector coupled to the engine, the controller further including instructions to adjust the fuel injection during purging responsive to the exhaust gas sensor and further responsive to the first, second, third, and fourth frequencies.

20. The system of claim 17, further comprising a temperature sensor coupled in a ventilation path of the canister, the controller further including instructions to adjust and/or deactivate the generated waves of the ultrasonic wave generator responsive the temperature sensor.

* * * * *